US005860790A

United States Patent [19]

Wang

[11] Patent Number: 5,860,790

[45] Date of Patent: Jan. 19, 1999

[54] AUTOMATIC DRAINING ARRANGEMENT WITHOUT POSITION LIMITATION

[76] Inventor: Hsiang-Yun Wang, 442 Jong FWU Rd., Jong Lih City Taur Yuan Shann, Taiwan

[21] Appl. No.: 728,210

[22] Filed: Oct. 10, 1996

[51] Int. Cl.[6] ..... F04B 49/00; F04B 49/10

[52] U.S. Cl. ..... 417/32; 417/36; 417/423.15

[58] Field of Search ..... 417/32, 36, 423.7, 417/423.14, 423.15; 137/216, 132, 101.25, 143

[56] References Cited

U.S. PATENT DOCUMENTS

| | | | |
|---|---|---|---|
| 4,255,361 | 3/1981 | Goettl | 261/27 |
| 4,361,522 | 11/1982 | Goettl | 261/66 |
| 4,576,552 | 3/1986 | Smith | 417/32 |
| 4,739,786 | 4/1988 | Parkinson | 417/36 |
| 5,216,288 | 6/1993 | Greene | 417/36 |
| 5,252,025 | 10/1993 | Kida et al. | 417/36 |
| 5,577,893 | 11/1996 | Nishikawa rt al. | 417/151 |

FOREIGN PATENT DOCUMENTS

| | | | |
|---|---|---|---|
| 405263780 | 10/1993 | Japan | 417/32 |

*Primary Examiner*—Timothy Thorpe
*Assistant Examiner*—Xuan M. Thai
*Attorney, Agent, or Firm*—David & Raymond; Raymond Y. Chan

[57] ABSTRACT

An automatic draining arrangement without position limitation includes a base plate, a water storage tank, a water tank mounting frame, a detecting control circuitry, a pump and a case, in which the water storage tank is installed on the base plate through the detecting control circuitry and pump, and also the case is provide on the base plate for protection, isolation of the interior mechanism. A drain tube is attached to the pump and extends outside of the arrangement. The detecting control circuitry controls water draining operation for arrangement that generate waste water, when the waste water reach certain level, the water would automatically drain out. This arrangement can eliminate problems caused by other draining method and the problem of location, plus the fact that this arrangement can set to different switches to drain out water either by pump or by siphon action which can save electricity power.

8 Claims, 3 Drawing Sheets

AUTOMATIC DRAINING ARRANGEMENT WITHOUT POSITION LIMITATION

BACKGROUND OF THE PRESENT INVENTION

The present invention relates to automatic draining arrangement, and more particularly to an automatic draining arrangement without position limitation which utilizes a detecting control circuitry to incorporate with the pump for automatic draining, so that it can improve over the usage limitation of the conventional arrangement and can easily move as required.

The major principle of a conventional automatic draining arrangement is to provide a water storage tank on a location that is higher than the water outlet of the drain tube. In the drain tube which is filled with water, due to the atmospheric pressure and the pressure generated from the height difference between the water storage tank and the drain tube, the water in the water storage tank which is located at higher ground would be forced automatically to drain out through the drain tube. In order to maintain this draining mechanism, the drain tube needs to be maintained fully charged with water. One way to accomplish this goal is to installed bothersome closed mechanism at both end of the drain tube. For first time usage of the conventional arrangement, the user is required to manually fill the drain tube with water for generating the siphon function. The conventional arrangement can have the function of automatically draining effect, however, during operation, it has at least the following shortcomings:

1. In order to utilize the siphon effect, the equipment (such as an air-condition, or moisture eliminator) needs to incorporated with the static head of the higher ground, usually the conventional draining arrangement must be installed in a position lower than the equipment. And the water outlet of the drain tube can not be higher than the conventional arrangement, otherwise the siphon action would lose its effect. If the equipment is installed in the basement, in order to drain out the water in the storage tank, it's obviously that the water outlet of the drain tube would be higher than the arrangement. Under this condition, the water would not go out, but reverse siphon action would occur. Therefore, the conventional arrangement is clearly not able to function in such situation.

2. In today's society, all the equipment have some basic requirements that need to fulfilled, which are to be portable, efficient, easy to used. For example, the hand held moisture eliminator are conventionally functioned on ground with roller instead of attaching on some high wall, so that the machine can usually move to any moist location anytime to remove the moisture. But for the conventional automatic draining arrangement, it is limited to its structure and can not be move at will. If the arrangement is positioned near the ground surface and the height difference is small, even though the siphon action still can cause water flow, the water can not drain off. It is because when encounter with the friction in the drain tube, it would almost eliminates all of the energy generated from the siphon action and completely stop the water flow. Even if the arrangement can still drain off water, since the draining speed is slower than the generating speed of the waster water, the water storage tank would be overflow and thus limited the usage of arrangement.

SUMMARY OF THE PRESENT INVENTION

The main object of the present invention is to provide an automatic draining arrangement without position limitation, which utilizes a detecting control circuitry to incorporate with a pump for automatic draining, so that it can improve over the usage limitation of the conventional arrangement and can easily be moved as required.

Another objective of the present invention is to provide an automatic draining arrangement without position limitation, which comprises a base plate, a case, a water storage tank, a detecting control circuitry, and a pump, wherein the detecting control circuitry is capable of controlling whether automatically drain by pump or switch to preset automatically siphon action drain, and can regulate among of water need to drain as required.

Still another objective of the present invention is to provide an automatic draining arrangement without position limitation, in which the detecting control circuitry further comprises an AC-DC voltage converting circuitry for converting alternating current to direct current voltage, a water level detecting circuitry, a electric pump driving circuitry, and a temperature overheat warning circuitry.

DETAILED DESCRIPTION OF THE PREFERRED EMBODIMENT

Figure 3:
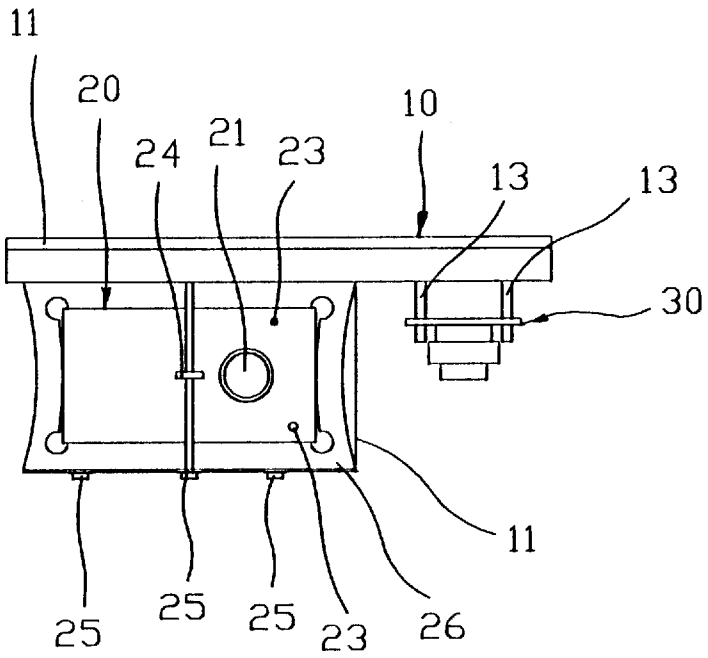
FIG. 3 is a top view illustrating the location of-the water storage tank of the above preferred embodiment according to the present invention.
Figure 1:
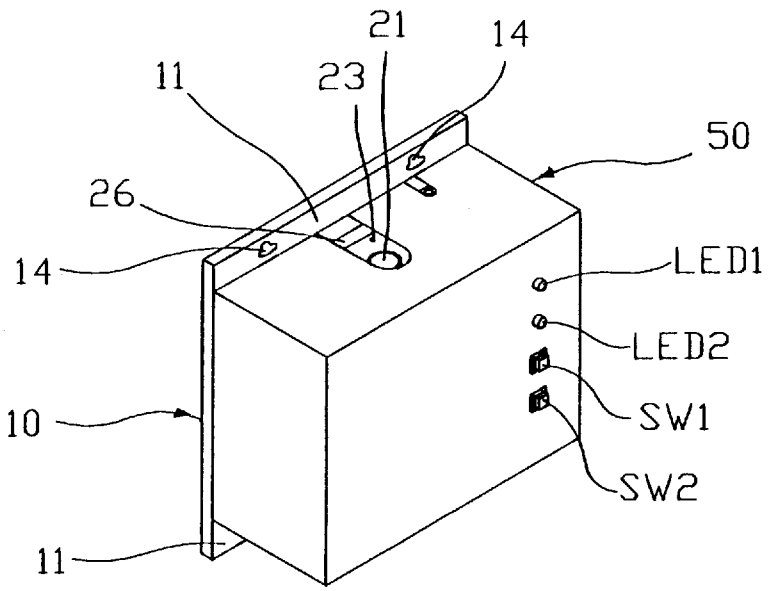
FIG. 1 is a perspective view of a preferred embodiment according to the present invention.
Figure 2:
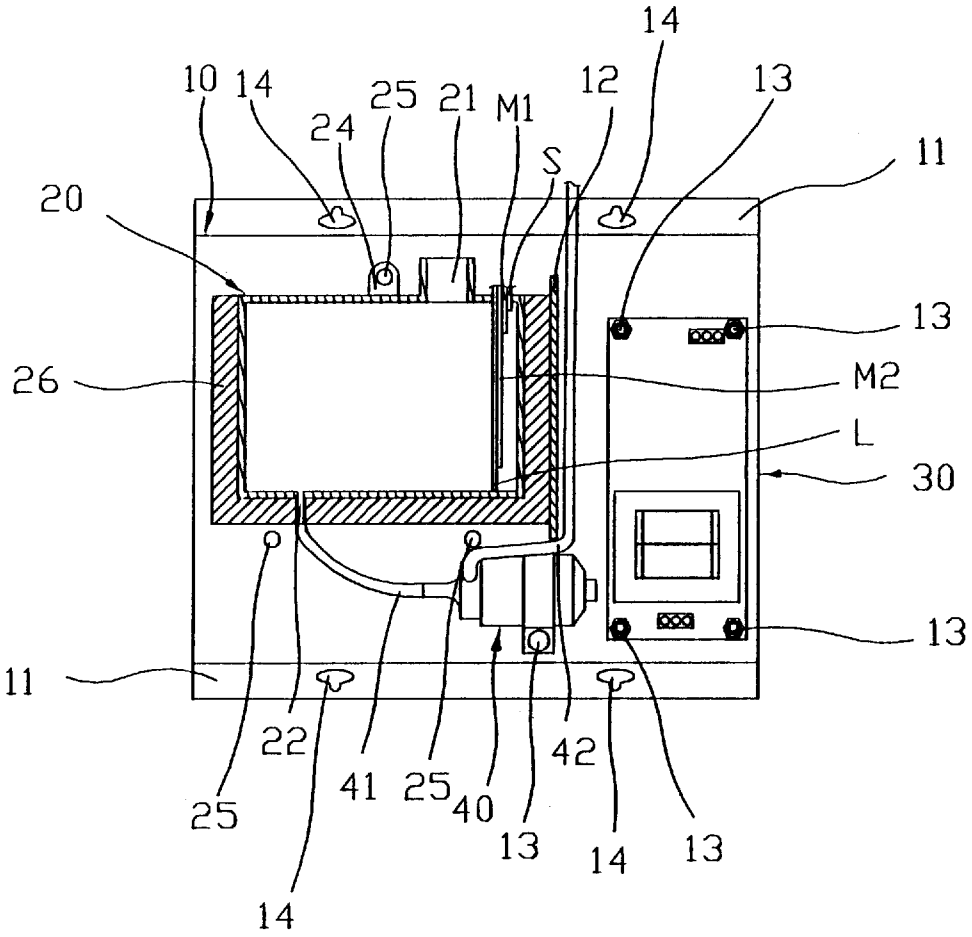
FIG. 2 is a partial sectional view illustrating the interior arrangement of the above preferred embodiment according to the present invention.

Referring to FIGS. 1 to FIG. 3 of the drawings, the present invention of automatic draining arrangement without position limitation comprises a base plate 10, a water storage tank 20, a detecting control circuitry 30, a pump 40, and a case 50.

The base plate 10 has an U-shaped cross section. On the periphery of both an upper end and a lower end of the base plate 10 is provided upper and a lower wing frame 11 respectively. The base plate 10 has installed a water tank mounting frame 12, a supporting seat 13, and four hanging holes 14 located at predetermined location of the upper and lower wing frames 11.

The water storage tank 20 is a hollow box having a water inlet 21 at a top surface thereof, a water outlet 22 at a bottom surface thereof, a vent hole 23 at the top surface thereof, and a fixed plate 24 for affixing the water storage tank 20 on the water tank mounting frame 12 of the base plate 10, in which the water storage tank is tight down by bolts and welts to the base plate 10.

Figure 4:
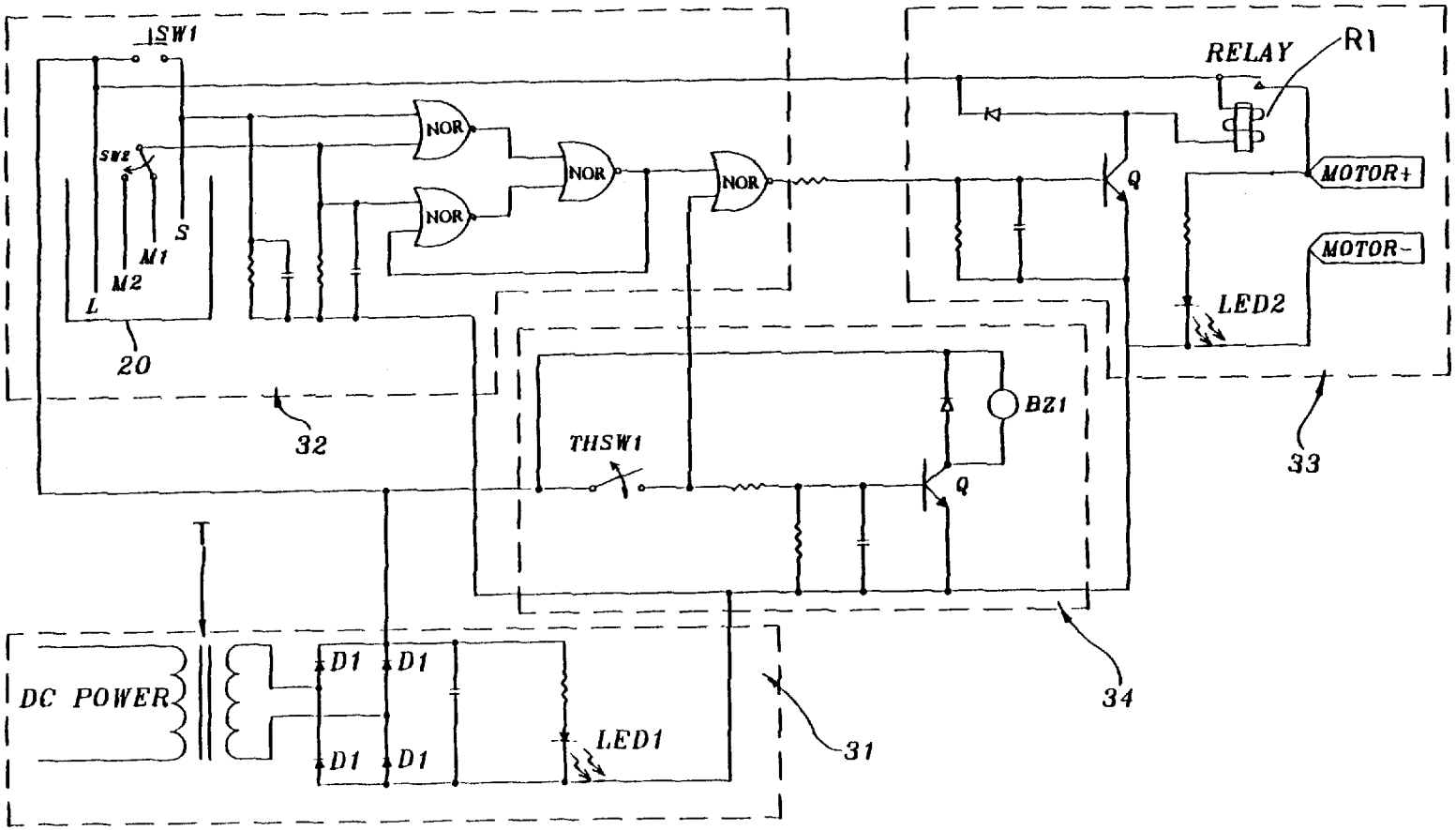
FIG. 4 is a circuit diagram of the detecting control circuitry of the above preferred embodiment according to the present invention.

The detecting control circuitry 30 (as shown in FIG. 4) is mainly installed on a circuitry plate which is affixed on the base plate 10 through the supporting seat 13. The detecting control circuitry 30 comprises an AC-DC voltage converting circuitry 31, a water level detecting circuitry 32, an electric pump driving circuitry 33, and a temperature overheat warning circuitry 34, in which the AC-DC voltage converting circuitry 31, which is a DC power source for the detecting control circuitry 30, transforms a normal alternating current voltage to a direct current voltage. The water level detecting circuitry 32 is used to detect the water level in the water storage tank 20 and sends out a signal to the electric pump driving circuitry 33. The electric pump driving circuitry 33 drives the electric motor pump 40 to pump out water from the water storage tank 20 or to stop the pumping out water. The temperature overheat warning circuitry 34 is to generate warning sound to notify the user when the pump motor 40 temperature is too high.

The AC-DC voltage converting circuitry 31 comprises four diodes D1, a photo diode LED1 and a transformer T electrically connected. These four diodes D1 construct a bridge rectify circuitry for converting the input AC voltage to DC voltage to provide the required DC power for the whole automatic draining control circuitry. The photo diode LED1 which is connected to the four diodes D1 is used to illustrate that the AC-DC voltage converting circuitry 31 is functioned under normal condition.

The water level detecting circuitry 32 comprises four water level detectors S, M1, M2, L installed in the water storage tank 20, four NOR logic gates, two switches SW1, SW2, and other corresponding elements electrically connected. Referring to FIGS. 2 and 4, the water level detector S is installed at a highest position of the water storage tank 20 for detecting the highest water level in the water storage tank 20 that required draining. The water level detector L is installed at a lowest position of the water storage tank 20 to detect the lowest water level. Both the water level detectors M1, M2 are installed at a higher and a lower positions respectively to detect the predetermined water levels for stopping the pumping of the motor pump 40.

Referring to FIGS. 1 and 4, the switch SW1 is a manual switch for turn on the electric pump 40. The switch SW2 is used to switch the automatic draining arrangement to operate under the siphon action for natural draining or the pump 40 for forced draining. This is an essential motive of the present invention, so that the arrangement of the present invention can be installed at any position.

Assume that the water storage tank 20 is installed at a location higher than the water outlet, then the siphon action principle can be applied for draining out water. When the switch SW1 is set at the water level detector M1, the pump 40 would be activated to continuously pump out water until the water level is lower than the water level detector M1. At this moment, the pump 40 stops and all the water in the water storage tank 20 would be drained out by means of the principle of siphon action.

If the water storage tank 20 is installed at a location lower than the water outlet, the switch SW1 should be set on the water level detector M2, so that the pump 40 would be activated to continuously pump out water until the water level is lower than the water level detector M2. Those signals from these water level detectors S, M1, M2, L are sent through the four NOR logic gates to generate an input signal to the electric pump driving circuitry 33.

The electric pump driving circuitry 33 comprises a transistor Q, a relay R1, a photo diode LED2, a temperature detector (not shown), and other corresponding elements electrically connected. The input signal of the electric pump driving circuitry 33 would electrically connect the transistor Q to activate the relay R1. And then the pump motor 40 is activated to drain off water. The photo diode LED 2 is turned on when the pump 40 is working under normal condition, so as to show that the circuitry is working properly. The temperature detector detects the temperature of the pump 40. When the temperature of the pump 40 exceeds a predetermined temperature limit such as 55 degree Celsius, the electricity of the pump 40 would be cut off, and thus stop pumping. When the temperature drops back to a predetermined temperature limit such as 45 degree Celsius, the pump 40 would turn back on. Therefore, the function of the pump 40 is protected from being burnt down because of overheating.

The temperature overheat warning circuitry 34 comprises a thermal protective switch THSW1, a transistor Q, a buzzer BZ1, and other corresponding elements electrically connected, in which the thermal protective switch THSW1 and the temperature detector of the electric pump driving circuitry 33 are interlocked. If the temperature detector of the electric pump driving circuitry 33 detects a temperature exceeding the predetermined temperature limit such as 55 degree Celsius, the thermal protective switch THSW1 would be activated to connect the circuitry. Therefore, the transistor Q is electrically conducted to allow the buzzer BZ1 to generate siren sound, and thus reach the warning effect.

The pump 40 is mounted on the base plate 10 and is activated through the control of the detecting control circuitry 30. An inlet of the pump 40 is connected with a connecting duct 41 which is further connected to the water outlet 22 of the water storage tank 20. An outlet of the pump 40 is connected to a drain tube 42 which is extended outside of the arrangement.

The case is a hollow box body mounted on the base plate 10 for the purpose of covering and protecting all of the interior mechanism.

Referring to FIG. 1 to FIG. 4, the operation and usage conditions of the control circuitry arrangement of the automatic draining system are described as follows.

If the water enters the water storage tank 20 through the water inlet 21 until the water level is raised to exceed the water level detector S, the water level detecting circuitry 32 would send out a signal to the electric pump driving circuitry 33 to start the pump 40, so that water would be drained out from the water outlet 22. If the location of the automatic draining arrangement is higher than the position of the water draining of the water outlet 22, fulfilling the condition of siphon action principle, the switch SW2 would be set on the water level detector M1. Therefore, when the water level is lowered to the water level detector M1, the pump 40 stops to save electricity power, and at this moment, the remaining water in the water storage tank 20 would be drained off due to the siphon action principle. If the position of the automatic draining arrangement is lower than the position of the water draining of the water outlet 22, the water in the water storage tank 20 needs to be pumped out by the electric motor pump 40. The switch SW2 would be set on the water level detector M2. Hence, when the water level is lowered to the water level detector M2, the pump 40 stops.

If anytime that the user wants to clean out the water in the water storage tank 20, simply pushing the switch SW1 would cause the water level detecting circuitry 32 to send out a signal to the electric pump driving circuitry 33 to activate the electric motor pump 40 which would pump out water through the water outlet 22.

If during the process of the pump 40 draining, the temperature of the pump 40 has exceeded a predetermined temperature limit such as 55 degree Celsius, the thermal protective switch THSW1 of the temperature overheat warning circuitry 34 which is interlocked with the temperature detector of the electric pump driving circuitry 34 would conduct the buzzer BZ1 which would generate the siren sound to notify the user, thus reaching the warning effect.

Furthermore, during the application of the present arrangement, it can be hung at any desired location by means of the hanging holes 14 according to the corresponding peripheral equipment, so that it has convenient mobility. Also, due to the motion pumping ability of the present arrangement, even if the water outlet is higher than the water storage tank, the draining action can still normally process. Therefore, even when present invention is placed at a low location (such as the basement), or utilized in a low located equipment (such as hand held moisture eliminator), it can still work normally. For usage above the ground, the installation of the present invention needs not to set too high, but adequately installed on a convenient location for easy movement. Moreover, since the arrangement is not immersed under the water for a long period of time, rusting and malfunction are not likely to occur. Thus normal draining is assured. The present invention also does not need to add water before the first time operation so that the operation steps of the arrangement is simplified.

I claim:

1. An automatic draining arrangement, comprising a base plate, a water storage tank, a detecting control circuitry, a pump, and a case, in which, said base plate has an U-shaped cross section and comprises two wing frames formed on an upper end and a lower end of said base plate, said base plate further comprising a water tank mounting frame and a supporting seat installed thereon, said two wing frames of said base plate having four hanging holes disposed therein;

said water storage tank being a hollow box having a water inlet at a top surface thereof, a water outlet at a bottom surface thereof, a vent hole at said top surface thereof, and a fixed plate for affixing said water storage tank on said water tank mounting frame of said base plate, wherein said water storage tank is secured by bolts and welts to said base plate;

said detecting control circuitry comprising an AC-DC voltage converting circuitry for converting an input AC power supply to a DC power voltage to provide said detecting control circuitry and said pump; a water level detecting circuitry for detecting a highest water level, a lowest water level, a higher water level, and a lower water level in said water storage tank and sending an input signal to an electric pump driving circuitry respectively; said electric pump driving circuitry receiving said input signal and activating said pump to pump out water from said water storage tank when the water level in said water storage tank is lower than said highest water level and to stop pumping when the water level in said water storage tank is lower than said higher water level, said lower water level and said lowest water level; and a temperature overheat warning circuitry for activating said pump to stop pumping when a temperature of said pump exceeds a predetermined temperature limit for protecting said pump; wherein said AC-DC converting circuitry, said water level detecting circuitry, said electric pump driving circuitry, and said temperature overheat warning circuitry are electrically connected on a circuitry plate which is affixed on said base plate through said supporting seat;

said pump being mounted on said base plate and being controlled by said detecting control circuitry, said pump having an inlet and an outlet wherein said inlet of said pump is connected with a connecting duct which is further connected to said water outlet of said water storage tank, said outlet of said pump being connected to a drain tube which extends outside of said automatic draining arrangement; and said case being a hollow box body mounted on said base plate for covering and protecting said automatic draining arrangement.

2. An automatic draining arrangement, as recited in claim 1, in which said AC-DC voltage converting circuitry comprises four diodes D1, a photo diode LED1 and a transformer T electrically connected, said four diodes D1 constructing a bridge rectifier circuitry for converting said input AC power to said DC voltage power to provide said required DC voltage power for said detecting control circuitry and said pump, said photo diode LED1 which is connected to said four diodes D1 being used to illustrate that said AC-DC voltage converting circuitry is functionings under normal conditions.

3. An automatic draining arrangement, as recited in claim 1, in which said water level detecting circuitry comprises four water level detectors S, M1, M2, L installed in said water storage tank, four NOR logic gates, and two switches SW1, SW2 electrically connected, said water level detector S being installed at a highest position of said water storage tank for detecting said highest water level in said water storage tank that required draining, said water level detector L being installed at a lowest position of said water storage tank to detect said lowest water level, both said water level detectors M1, M2 being installed at a higher and a lower positions respectively to detect said predetermined higher and lower water levels respectively for stopping said pumping of said motor pump, said switch SW1 being a manual switch for turning on said electric pump, said switch SW2 being used to switch said automatic draining arrangement either to operate under a siphon condition for natural draining or to operate said pump for forced draining, thereby when said water storage tank is installed at a location higher than said water outlet, said water in said water storage tank is drained off under said siphon condition, wherein when said switch SW1 is set at said water level detector M1, said pump is activated to continuously pump out water until said water level is lower than said water level detector M1, and that said pump stops and said water in said water storage tank is drained out under said condition of siphon, however when said water storage tank is installed at a location lower than said water outlet, said switch SW1 is set on said water level detector M2, so that said pump is activated to continuously pump out water until said water level is lower than said water level detector M2, in which a plurality of signals from said water level detectors S, M1, M2, L are sent through said four NOR logic gates to generate said input signal to said electric pump driving circuitry.

4. An automatic draining arrangement, as recited in claim 2, in which said water level detecting circuitry comprises four water level detectors S, M1, M2, L installed in said water storage tank, four NOR logic gates, and two switches SW1, SW2 electrically connected, said water level detector S being installed at a highest position of said water storage tank for detecting said highest water level in said water storage tank that required draining, said water level detector L being installed at a lowest position of said water storage tank to detect said lowest water level, both said water level detectors M1, M2 being installed at a higher and a lower positions respectively to detect said predetermined higher and lower water levels respectively for stopping said pumping of said motor pump, said switch SW1 being a manual switch for turning on said electric pump, said switch SW2 being used to switch said automatic draining arrangement either to operate under a siphon condition for natural draining or to operate said pump for forced draining, thereby when said water storage tank is installed at a location higher than said water outlet, said water in said water storage tank is drained off under said siphon condition, wherein when said switch SW1 is set at said water level detector M1, said pump is activated to continuously pump out water until said water level is lower than said water level detector M1, and that said pump stops and said water in said water storage tank is drained out under said condition of siphon, however when said water storage tank is installed at a location lower than said water outlet, said switch SW1 is set on said water level detector M2, so that said pump is activated to continuously pump out water until said water level is lower than said water level detector M2, in which a plurality of signals from said water level detectors S, M1, M2, L are sent through said four NOR logic gates to generate said input signal to said electric pump driving circuitry.

5. An automatic draining arrangement, as recited in claim 1, in which said electric pump driving circuitry comprises a transistor Q, a relay R1, and a photo diode LED2 electrically connected, wherein said input signal of said electric pump driving circuitry is electrically connected said transistor Q to activate said relay R1, and then said pump is activated to drain off water, said photo diode LED2 being turned on when said pump is working under normal condition, so as to show that said detecting control circuitry is working properly.

6. An automatic draining arrangement, as recited in claim 4, in which said electric pump driving circuitry comprises a transistor Q, a relay R1, and a photo diode LED2 electrically connected, wherein said input signal of said electric pump driving circuitry is electrically connected said transistor Q to activate said relay R1, and then said pump is activated to drain off water, said photo diode LED2 being turned on when said pump is working under normal condition, so as to show that said detecting control circuitry is working properly.

7. An automatic draining arrangement, as recited in claim 1, in which said temperature overheat warning circuitry comprises a thermal protective switch THSW1, a transistor Q, and a buzzer BZ1 electrically connected, in which said thermal protective switch THSW1, whereby when said electric pump has a temperature exceeding said predetermined temperature limit, said thermal protective switch THSW1 is activated to connect said electric pump driving circuitry, so that said transistor Q is electrically conducted to allow said buzzer BZ1 to generate a siren sound.

8. An automatic draining arrangement, as recited in claim 6, in which said temperature overheat warning circuitry comprises a thermal protective switch THSW1, a transistor Q, and a buzzer BZ1 electrically connected, in which said thermal protective switch THSW1, whereby when said electric pump has a temperature exceeding said predetermined temperature limit, said thermal protective switch THSW1 is activated to connect said electric pump driving circuitry, so that said transistor Q is electrically conducted to allow said buzzer BZ1 to generate a siren sound.

* * * * *